United States Patent [19]

Elliott et al.

[11] Patent Number: 4,703,406

[45] Date of Patent: Oct. 27, 1987

[54] ONE PIECE LAMP MOUNTING FOR RECESSED LIGHT FIXTURES

[75] Inventors: Franklin E. Elliott; Anatoly Kudishevich, both of Los Angeles, Calif.

[73] Assignee: Capri Lighting, Calif.

[21] Appl. No.: 911,014

[22] Filed: Sep. 24, 1986

[51] Int. Cl.[4] ..... F21S 1/06

[52] U.S. Cl. ..... 362/365; 362/148; 362/368; 362/377

[58] Field of Search ..... 362/269, 287, 364–370, 362/148, 427, 430, 377, 378

[56] References Cited

U.S. PATENT DOCUMENTS

| | | | |
|---|---|---|---|
| 1,129,125 | 2/1915 | Rubin | 362/377 |
| 3,515,864 | 6/1970 | Levy et al. | 362/427 |
| 3,609,346 | 9/1971 | Lund et al. | 362/364 |
| 4,510,559 | 4/1985 | Kristofek | 362/368 |

FOREIGN PATENT DOCUMENTS

| | | | |
|---|---|---|---|
| 30714 | 4/1926 | France | 362/377 |

*Primary Examiner*—James C. Yeung
*Attorney, Agent, or Firm*—John E. Wagner

[57] ABSTRACT

A lamp mounting structure for use in recessed lighting fixtures comprises a planar portion having an illumination aperture over which a translucent plate may be removably retained. A lamp may be removably retained over said aperture by resilient tabs which extend inwardly beyond the edges of the aperture so as to engage the lamp whether or not such a translucent plate is interposed between it and the planar portion of the lamp mounting structure.

4 Claims, 8 Drawing Figures

ONE PIECE LAMP MOUNTING FOR RECESSED LIGHT FIXTURES

The present invention relates to improvements in illumination fixtures for wall or ceiling installation, and more particularly to a novel one piece lamp and lens mounting for use in recessed incandescent lighting fixtures with any of a large variety of trim structures designed for such installation.

Conventional recessed incandescent lighting fixtures, such as, for example, those employed in low voltage ceiling installations, typically comprise trim structures consisting of a base in the form of a slightly dished circular trim plate provided with a central illumination opening, some means such as a cannister for retaining the structure in a ceiling opening with the trim plate covering the edges of the opening and a lamp mounting for holding an electric lamp, which is usually dome shaped, in a position in alignment with the illumination opening. A color filter or a heat absorbing glass lens often is present in the fixture.

The lamp mountings employed in such fixtures have included a lamp mounting plate having an aperture adapted to be aligned with the illumination opening of the trim structure; an upturned edge of that plate being riveted to a support carried by the trim plate, and a pair of flexible spring wires extended from the remote edge of the lamp mounting plate upwardly to the support to retain the dome shaped lamp in position in alignment with the lamp mounting plate aperture. A separate glass plate covering that aperture has been carried by a separate retainer secured below the plate. Three or four parts have typically been fabricated and then assembled to produce a single lamp mount.

The lighting fixture manufacturing industry is an intensely competitive one in which savings in manufacturing cost have become increasingly important. As a part of the effort to increase such savings, the present invention has had as its principal object the provision of an easily fabricated one piece lamp mounting for incorporation in such lighting fixtures, performing the multiple functions which heretofore required complex structures.

SUMMARY OF THE INVENTION

The lamp mounting of the present invention is formed from a single metal stamping to provide an open top box with an apertured bottom and a pair of resilient bifurcated tabs opposite each other for removably retaining a dome shaped electric lamp in position over an illumination opening in the box and to provide upturned edges of the plate defining the box for positioning a translucent plate over the opening; one such upturned edge being of sufficient size to adapt it to act as a mounting plate for the lamp mounting. This larger plate may be riveted or pivotally secured to a support attached to the trim structure.

The lamp mounting may be similarly staked to the trim thereby providing at least three different methods of assembly into the fixture.

DETAILED DESCRIPTION OF THE PREFERRED EMBODIMENT

Figure 1:
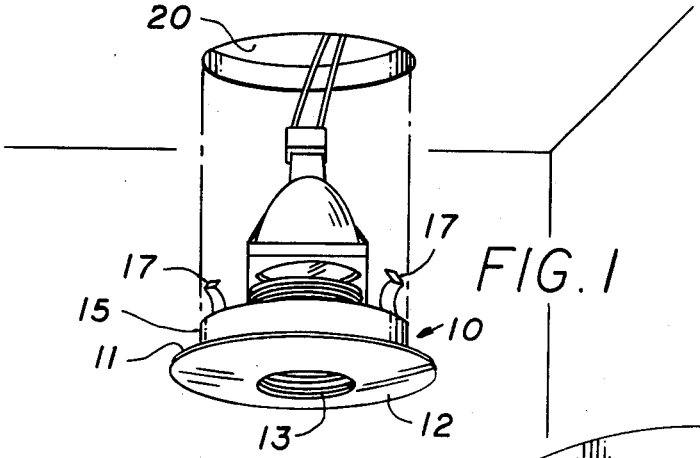
FIG. 1 is a view in perspective of a recessed incandescent fixture including the lamp mounting of the present invention.

The lamp mounting of the present invention forms a part of a recessed incandescent fixture designed for ceiling or wall installation which includes a metal trim structure 10 of FIGS. 1, 2, 3, 4 and 7. This trim structure 10 includes a base 11 in the form of a slightly dished circular trim plate 12 provided with a central illumination opening 13. Surrounding the opening 13 is a tubular casing 15 having an inwardly formed edge 16 appearing in FIG. 3, secured to the plate 12 as by welding. Resilient retainers 17 are attached to the casing 15, as by rivets 18, at 120 degree intervals around its circumference.

The trim structure 10 is designed to be inserted in a ceiling or wall hole 20 sized to snugly receive the casing 15 and held in place by the retainers 17 with the trim plate 12 concealing the edge of the hole 20.

Figure 2:
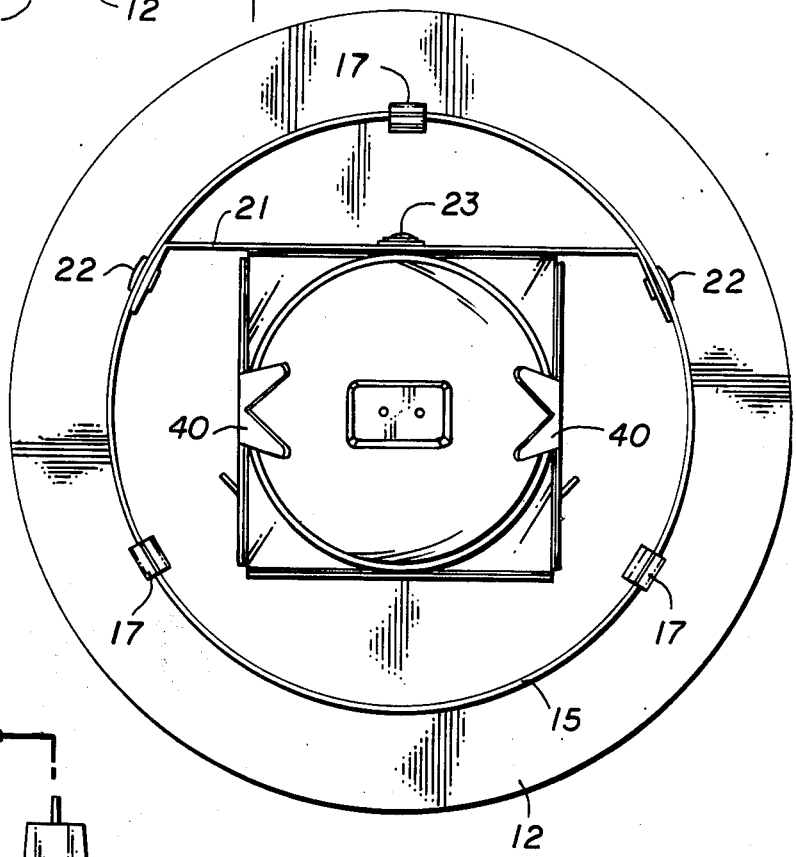
FIG. 2 is a view in plan of the fixture of FIG. 1.
Figure 3:
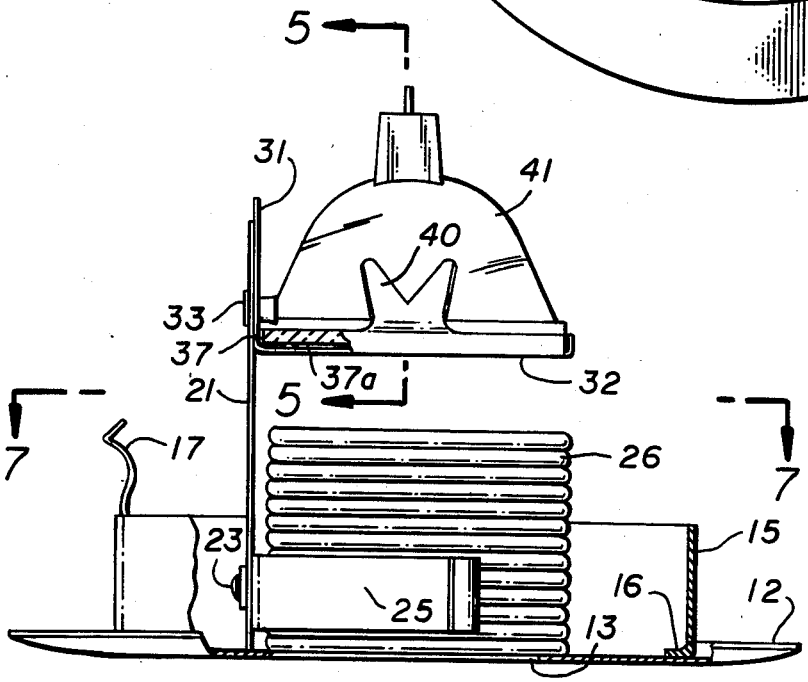
FIG. 3 is a view in side elevation and partially in section of the fixture of FIG. 2.
Figure 4:
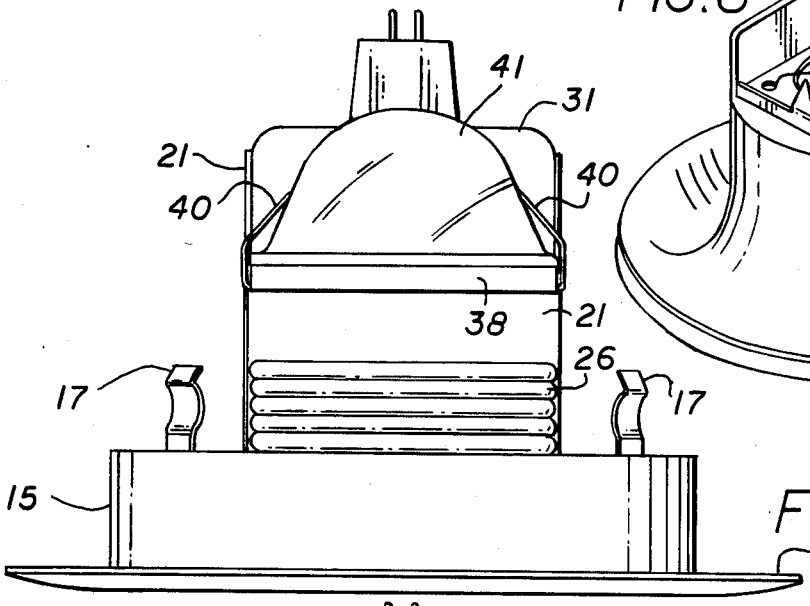
FIG. 4 is a view in side elevation normal to the view of FIG. 3.

A lamp standard 21 of FIG. 2 extends along a chord of the tubular casing 15 and is secured to the interior wall of the casing as by rivets 22. Attached to the standard 21 adjacent the plate 12, as by insulating washer 23, is a bowed leaf spring 25 which holds in a position in alignment with the illumination opening 13 a tubular light shield 26 which is only slightly larger in diameter than the opening 13.

The structure described in this detailed description up to this point is conventional in illumination fixtures in which a variety of arrangements for carrying a light source on the upper portion of the lamp standard aligned with the central illumination opening, have been employed.

Figure 6:
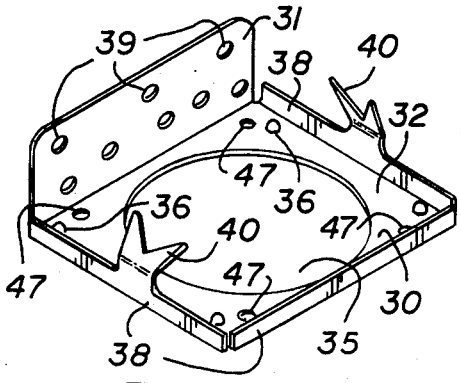
FIG. 6 is a view in perspective of the lamp mounting of the present invention.
Figure 7:
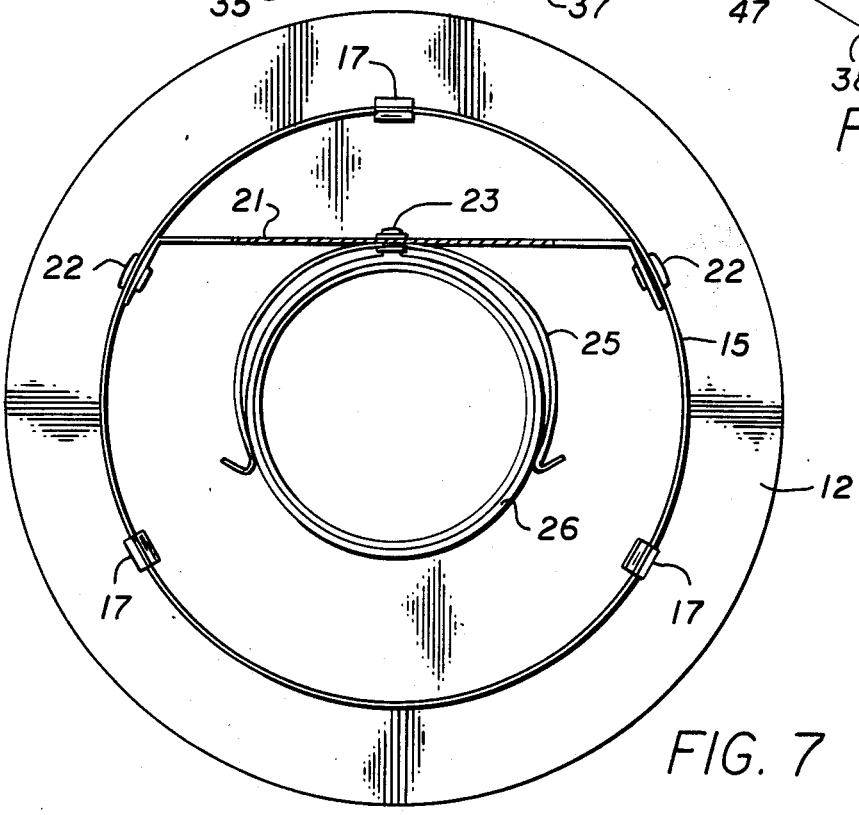
FIG. 7 is a view in plan and partially in section taken on the line 7—7 of FIG. 3.

The one piece lamp mounting of the present invention, best seen in FIGS. 2, 3, 4, 5 and 6, and show in perspective in FIG. 6, comprises rectangular metal lamp support plate 30 having one large edge portion 31 and three shorter upstanding edge portions 38 formed at a right angle to the main portion 32 of plate 30 to define an open top box. The larger edge portion 31 includes a number of openings 39 used for securing the lamp mounting 30 from the side and to allow its pivoting where a pivoted lamp is desirious. In the embodiment of FIGS. 1–4, one of the opening is used in securing the lamp mounting to the lamp standard 21, as by rivets 33, and so that the main portion 32 of the plate is disposed over the central illumination opening 13. The main portion 32 has a central opening 35 which in the assembly is aligned with the opening 13 and the interior of the tubular light shield 26.

Adjacent the corners of plate 30, four bosses 36 are formed in the plate 30 to support plate 37 of heat absorbing glass in spaced relationship to the balance of the plate's surface, and the edge 38 of the plate 30 retain the glass plate 37 in position over the opening 30. If desired, a color filter 37*a* (FIG. 3) may be interposed between the glass plate 37 and the main portion 32 of the plate 30.

Figure 8:
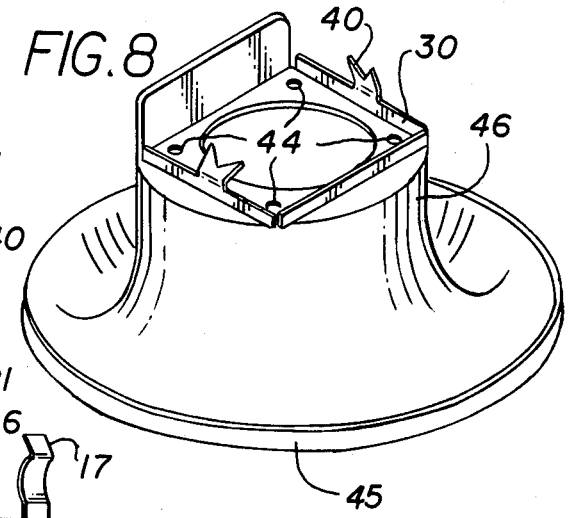
FIG. 8 is a perspective view of a cast trim with the lamp mounting of this invention staked to the rear side thereof.
Figure 5:
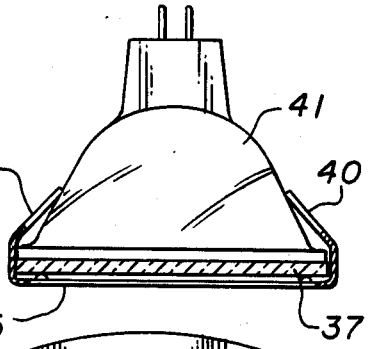
FIG. 5 is a detail view partially in section taken on the line 5—5 of FIG. 3.

The lamp mounting of the present invention is adapted for mounting on any of a wide variety of trim structures. As shown in FIG. 8, for example, a cast trim plate 45 is provided with an upstanding skirt 46, carrying lugs 44 spaced to align with four holes 47 (FIG. 6) in the lamp mounting plate 30. This arrangement permits the plate 30 to be supported on the lugs 44, the upper ends of which are provided with end portions sized to pass through the holes 47, which end portions then may be staked to retain the plate 30 in place.

At opposite sides of the plate 30, the edges are formed into bifurcated tabs 40 which are resilient and serve to embrace the outer surface of a dome shaped lamp housing 41 of conventional construction and removably retain it in position over the opening 35.

The foregoing is merely representative of this invention and is not to be considered as limiting. It is recognized that those skilled in the art to which this invention pertains are capable of producing embodiments which may appear different but do not depart from the spirit and scope of this invention. Therefore this invention shall not be limited to the illustrative embodiment but rather to the claims as set forth below which constitute definitions of this invention including the protection afforded by the doctrine of equivalents.

What is claimed is:

1. A one-piece lamp mounting for attachment to a trim structure having a base provided with an illumination opening and with means adjacent said opening for supporting a lamp mounting comprising:

a planar main portion having
an illumination aperture,
means for removably retaining a translucent plate in a position overlying said aperture including
circumferentially disposed edges of said main portion extending at a right angle to the plane of said main portion,
and
means for retaining a lamp in a position over said aperture, either in direct contact with said main portion or with said translucent plate interposed, including
a plurality of resilient tabs integral with said edges and extending inwardly beyond the edge of said aperture.

2. A one piece lamp mounting according to claim 1 in which the free ends of said tabs are bifurcated whereby each is adapted to make multiple contact with a domed lamp housing.

3. A one-piece lamp mounting according to claim 1 in which a series of bosses are provided in said planar main portion for supporting a translucent plate in spaced relation to the balance of the surface of said main portion.

4. A one-piece lamp mounting according to claim 2 in which a series of bosses are provided in said planar main portion for supporting a translucent plate in spaced relation to the balance of the surface of said main portion.

* * * * *